United States Patent [19]

Pinto

[11] 4,360,802

[45] Nov. 23, 1982

[54] AUTOMATIC THEFT AND FIRE ALARM APPARATUS FOR FIRE EXTINGUISHERS

[76] Inventor: Anthony A. Pinto, 366 N. Main St., Andover, Mass. 01810

[21] Appl. No.: 240,250

[22] Filed: Mar. 3, 1981

[51] Int. Cl.[3] ..... G08B 13/14

[52] U.S. Cl. ..... 340/568; 169/23; 200/61.58 R

[58] Field of Search ..... 340/568; 169/23, 51; 200/61.58 R

[56] References Cited

U.S. PATENT DOCUMENTS

| | | | |
|---|---|---|---|
| 3,042,910 | 7/1962 | Shull | 340/568 |
| 3,893,095 | 7/1975 | De Jong | 340/568 |
| 4,003,048 | 1/1977 | Weise | 340/568 |
| 4,015,250 | 3/1977 | Fudge | 340/568 |

*Primary Examiner*—Glen R. Swann, III

*Attorney, Agent, or Firm*—Pearson & Pearson

[57] ABSTRACT

A quick releasable clamp bracket for supporting a portable fire extinguisher on a wall mounted panel is provided with the conventional vertical affixation strap and lateral flexible clamping strap, the straps overlapping in a double thick welded area midway of the height of the affixation strap. An electric alarm switch is embedded in the panel under the overlap area with its spring actuated push button extending through registering holes in the overlap to contact the body of the extinguisher. Removal of the extinguisher from the bracket causes the push button to spring out and close the alarm circuit.

5 Claims, 4 Drawing Figures

Fig. 1.
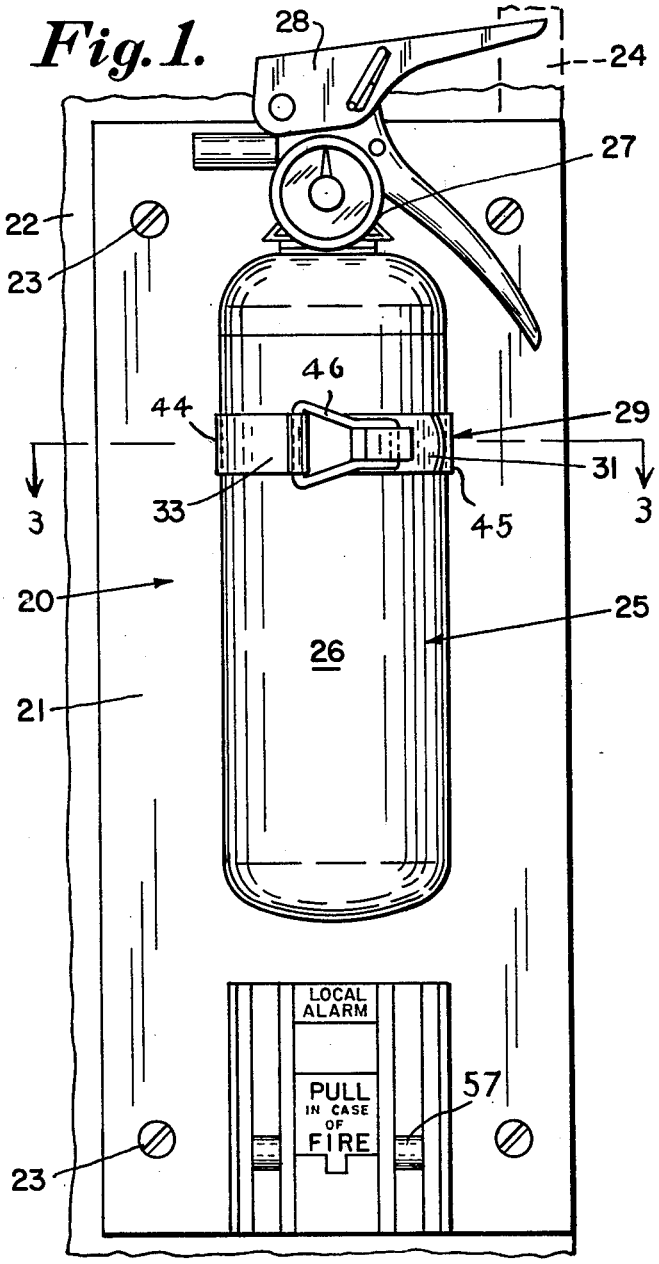
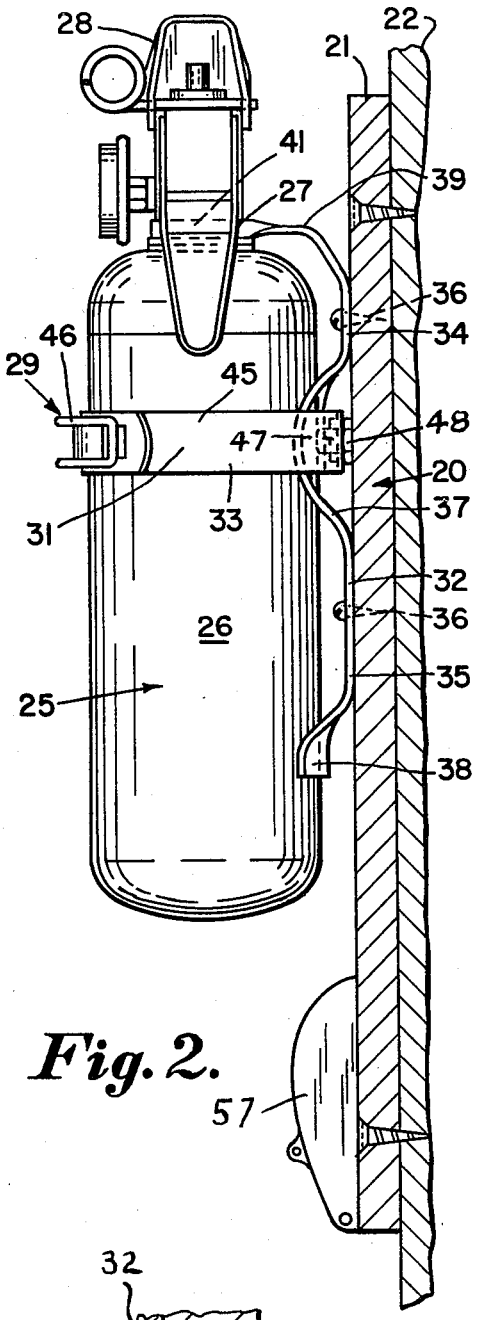
Fig. 2.
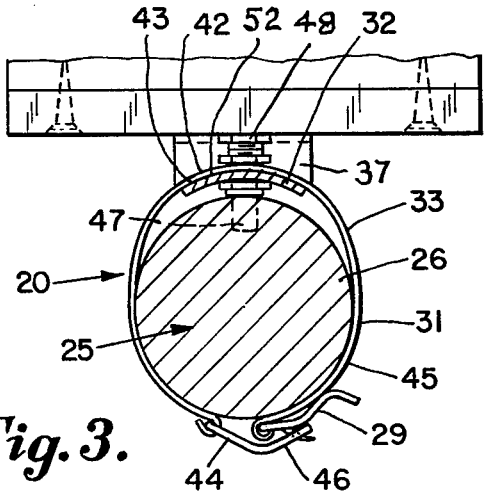
Fig. 3.
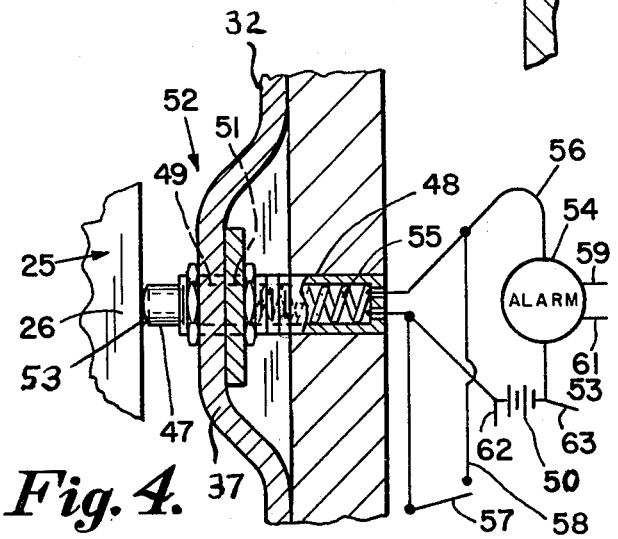
Fig. 4.

AUTOMATIC THEFT AND FIRE ALARM APPARATUS FOR FIRE EXTINGUISHERS

BACKGROUND OF THE INVENTION

It has long been a problem in public buildings, apartment houses and the like to equip common hallways, to which the public has access, with portable fire extinguishers in such manner that they will not be stolen. In addition, it has sometimes occurred that a portable fire extinguisher has been entirely, or partially, used to extinguish a fire and then replaced in its bracket with no alarm sounded and the fire not fully extinguished.

In an attempt to be sure that an alarm is sounded as soon as an extinguisher is removed from its holder, it has been proposed to enclose the extinguisher in a wall mounted box with a door, the opening of the door closing the alarm circuit, as in U.S. Pat. No. 3,042,910 to Shull of July 3, 1962.

Removing the weight of a fire extinguisher from its holder permits a spring plunger to rise and sound an alarm in U.S. Pat. No. 3,893,095 to Dejong of July 1, 1975 and both a door actuated switch and weight actuated switch are proposed in U.S. Pat. No. 4,015,250 to Fudge of Mar. 29, 1977.

However, the above devices, and other expedients are either too costly to manufacture or can be circumvented by a thief in slipping a cardboard, or screwdriver into the switch to hold it closed and than taping it while the extinguisher is removed without sounding the alarm.

SUMMARY OF THE INVENTION

In this invention no box with a door is required but preferably only a panel which is attached by screws to a 2×4 stud of an interior wall of a common hallway. A conventional bracket for portable, bottle-shaped, fire extinguishers is used, the vertical affixation strap of the bracket being affixed to the panel by screws and the horizontal, or lateral, flexible, clamping strap being releasably latched around the body of the extinguisher. An integral outwardly projecting arm on the affixation strap has a bifurcated end which fits around the neck of the extinguisher to prevent it from being raised or lowered while in the clamp bracket.

A conventional, commercially available fire alarm pull switch handle is mounted on the panel, below the extinguisher and marked "LOCAL ALARM" "PULL IN CASE OF FIRE". The pull switch is connected to house current, plus a battery back up, in case the house wires are cut and is in circuit with an auditory fire alarm signal system in the building and preferably also with a line to the nearest fire station.

The automatic fire extinguisher theft and alarm system of the invention consists in the provision of a push button electric switch located in the panel under the welded area of overlap of the outwardly bent, arcuate portion of the affixation strap and the central rear, or base portion, of the flexible clamping strap. Not only is the switch thus covered and partially hidden, but the push button of the switch projects outwardly through registering holes in the overlap area of the straps to contact the side of the body of the portable fire extinguisher. The push botton is spring pressed outwardly but the switch is normally open when the button is pressed inwardly by the extinguisher. Upon removal of the extinguisher, the button pops out under spring pressure to close the alarm circuit notifying all in the area, and the fire department of the fire and that the extinguisher has been removed.

The principal advantage of the structure of the invention is that a thief cannot slip a cardboard, or screwdriver sidewise into the bracket to hold the button closed while he tapes it closed and steals the extinguisher. The button is protected on all sides by the double thickness of the metal of the welded overlying straps and, in fact, the existence of the switch is not readily apparent to warn the potential thief.

BRIEF DESCRIPTION OF THE DRAWING

FIG. 1 is a front elevation of an automatic alarm fire extinguisher bracket of the invention, FIG. 2 is a side elevation thereof, FIG. 3 is a top plan view thereof in section on line 3—3 of FIG. 1, and FIG. 4 is an enlarged fragmentary, diagramatic top plan view showing the push button switch in closed circuit position and showing the electric alarm circuit.

DESCRIPTION OF A PREFERRED EMBODIMENT

The automatic fire and theft alarm, apparatus 20 of the invention includes a panel 21 mounted on a wall 22 of a common hall, or passageway, of a multi-family dwelling, office building, industrial plant, school, or the like, by screws 23 into one of the upright studs 24.

A portable, fire extinguisher 25, of generally bottle shape, with an elongated, cylinderical body 26, a neck 27 of reduced diameter, and a pull ring type, spring discharge handle 28 of increased dimensions is illustrated, such extinguishers being well known and usable in automobiles, boats etc. and therefore subject to theft.

The fire extinguisher 25 is supported in clamp bracket means 29, consisting of a clamp bracket 31 having an elongated affixation strap 32 of metal and a flexible, clamping strap 33 of metal, the affixation strap 32 having an upper straight portion 34 and a lower straight portion 35 secured to panel 21 by screws 36, and separated by an intermediate portion 37 arcuately bent outwardly away from the panel.

Affixation strap 32 also includes an integral lower free terminal bent arm 38 projecting outwardly to contact the body 26 of fire extinguisher 25 and an integral upper free terminal arm 39 bent outwardly away from panel 21 and having a bifurcated tip 41 which receives and embraces the reduced neck 27 of the extinguisher 25.

The flexible clamping strap 33 has its central, or base, portion 42 welded soldered or otherwise affixed to the underside surface 43 of the arcuately bent portion 37 of the affixation strap 32 so that its two laterally extending free terminal ends 44 and 45, each with suitable releasable latch mechanism 46 may be tightened and releasably encircled around the body 26 of the extinguisher 25.

It will be understood that if the switch of an alarm system contacted the body 26, to be held in open circuit position, at an exposed location it would be relatively easy for a thief to slip a screwdriver, or cardboard between body and push button to hold it back, then remove the extinguisher and then adhesively tape the push button back all without energizing the alarm circuit.

Therefore, in this invention, access to the push button is denied to the thief, by locating the push button 47 of the alarm switch 48 under both the bent portion 37 of the affixation strap 32 and the base portion 42 of the clamping strap 33. A pair of registering holes 49 and 51 are formed in the double thick, welded metal, overlap area 52 through which the elongated push button 47 projects from switch 48, embedded in panel 21, the free terminal tip 53 contacting the body 26 of the extinguisher 25 when clamped in bracket 31. Thus so long as the extinguisher is in the bracket, it will not be possible for a thief to successfully deactivate the switch 48 due to its protection by the crossed straps of the bracket.

As shown in FIG. 4 the switch 48 is in circuit with a source of current 53, such as house electric supply, and a visual, and/or auditory fire alarm 54 and the switch button, when coil spring 55 is compressed, does not close the circuit. However, removal of the extinguisher 25 from bracket 31, causes the button 47 to spring outwardly, as shown in dotted lines in FIG. 3, to close the theft and fire alarm circuit 56.

Preferably a pull switch 57 is mounted on panel 21 below bracket 31 and is included in a circuit 58 (FIG. 4) to close the circuit to the alarm manually when required. A pair of leads 59 and 61 from alarm 54 connect the alarm to the local fire station and a pair of leads 62 and 63 from the source 53 connect to a battery back-up system, represented by battery 50.

In operation, removal of the fire extinguisher 25 from the bracket 31 immediately energizes the building alarm to notify all occupants to evacuate the building. This avoids the danger of a localized effort to contain a blaze, which if unsuccessful, may result in the occupants being unable to flee the fire in time.

Fire prevention codes require that alarm systems be so equipped that when an alarm is activated, it also activates a latching relay in the master alarm box. The master alarm can only be deactivated by a building superintendent or by the fire department who also have keys to open the master alarm box to deactivate the alarm. By connecting the switch 48, of this invention, into the building alarm system, it is assured that any fire extinguisher removed from any bracket will be inspected, refilled and returned into place in its bracket ready for use again.

I claim:

1. Apparatus for preventing the theft of a fire extinguisher located in an area to which the public has access, said apparatus comprising:

a portable, elongated, bottle-shaped, fire extinguisher having a generally cylindrical body and a neck of reduced diameter;

a panel, adapted to be mounted on a wall of a common hallway of a building;

a fire extinguisher clamp bracket having an elongated metal affixation strap with upper and lower straight portions affixed flatwise to said panel, said upper portion mounting an outwardly extending, bifurcated arm engaging the neck of said extinguisher and said portions being spaced apart by an intermediate arcuate portion bent away from said panel;

said bracket having a flexible, metal clamping strap with a central portion affixed to the inside of the intermediate, arcuate portion of said elongated metal strap and a pair of laterally extending terminal ends, each with releasable latch means thereon, for encircling and clamping around the body of said extinguisher;

said intermediate arcuate portion of said affixation strap and the underlying central portion of said clamping strap each having registering holes therethrough;

and an electric alarm circuit including a source of electricity, an electrically energized fire alarm and a normally closed, electric push button switch located in said panel under said arcuate portion, the push button of said switch extending through said registering holes for contact with the body of said fire extinguisher when it is in said bracket to maintain said circuit in open condition;

whereby the holding of said switch in open condition by sliding an object between said extinguisher and said bracket is prevented by said arcuate portion and said central portion of said straps but removal of said extinguisher from said bracket closes said circuit and energizes said alarm.

2. Apparatus as specified in claim 1 wherein:

said electric alarm circuit includes a direct circuit to a fire station.

3. Apparatus as specified in claim 1 wherein said electric alarm circuit includes the electricity supply system of the area and a battery back up system for energizing said alarm in the event the area system is not in operation.

4. A clamp bracket for portable fire extinguishers of the type mountable on a wall and having a vertical affixation strap and a laterally extending clamping strap with its rear central portion affixed to an outwardly bent arcuate portion of the affixation strap characterized by:

the overlying areas of the rear central portion of said clamp strap and the outwardly bent arcuate portion of said affixation strap having registering holes therethrough for receiving the push button of an electric alarm switch.

5. A combined theft and fire alarm for portable fire extinguishers comprising a portable fire extinguisher;

fire extinguisher clamp bracket means for releasably supporting said portable fire extinguisher on a wall, said clamp bracket means including a metal affixation strap with an outwardly bent arcuate portion and a flexible, latchable, clamping strap with a rear central portion affixed to the outwardly bent arcuate portion of said affixation strap to form a double thickness area;

an electric circuit including a source of electricity, an electric fire and theft alarm and a normally closed, push button switch;

the push button of said switch projecting through said registering holes and normally held open by contact with the body of said fire extinguisher while in said clamp bracket means, but springing outwardly to close said circuit when said extinguisher is removed from said clamp bracket means.

* * * * *